US005705982A

United States Patent [19]

Faltings

[11] Patent Number: 5,705,982

[45] Date of Patent: Jan. 6, 1998

[54] INTRUSION DETECTION, REGISTER AND INDICATION APPARATUS

[75] Inventor: John P. Faltings, Manchester, N.H.

[73] Assignee: North America Technitron Corporation, Manchester, N.H.

[21] Appl. No.: 693,809

[22] Filed: Aug. 1, 1996

[51] Int. Cl.[6] ..... G08B 13/00

[52] U.S. Cl. ..... 340/541; 235/1 R; 235/93; 235/128; 340/545; 340/547; 340/554; 340/566

[58] Field of Search ..... 340/541, 545, 340/547, 566, 554; 235/1 R, 93, 128

[56] References Cited

U.S. PATENT DOCUMENTS

| | | | |
|---|---|---|---|
| 4,006,460 | 2/1977 | Hewitt et al. | 340/541 |
| 4,241,337 | 12/1980 | Prada | 340/547 |
| 4,257,038 | 3/1981 | Rounds et al. | 340/541 |
| 4,427,975 | 1/1984 | Klazle | 340/547 |
| 4,797,663 | 1/1989 | Rios | 340/541 |
| 4,903,010 | 2/1990 | Greene | 340/541 |
| 5,400,011 | 3/1995 | Sutton | 340/566 |
| 5,450,060 | 9/1995 | Parkhurst | 340/541 |

*Primary Examiner*—Glen Swann
*Attorney, Agent, or Firm*—Devine, Millimet & Branch, Professional Association

[57] ABSTRACT

An apparatus for detecting intrusions into spaces of various kinds such as apartments, offices, lockers, and the like by either authorized or unauthorized persons apparatus monitors a specific portal for intrusion occurrence events using an intrusion sensing unit, which communicates intrusion occurrence information to a remote, and possibly hidden monitor unit. The monitor dynamically counts the number of valid intrusion occurrence signals received from the sensing unit and stores the same in non-volatile memory. The number of intrusions stored in memory can be displayed on a display means at the monitor unit, which, in a simple embodiment would take the form of a single, seven segment light emitting diode (LED) display. In addition, the number of intrusions stored in the non-volatile memory can only be reset by the input of a unique, coded personal identification number (PIN) signal from an input keypad located on the monitor unit. More sophisticated embodiments incorporate date and time displays to indicate more specifically the events surrounding a particular intrusion occurrence. Even more sophisticated embodiments incorporate a primer for producing a hardcopy of intrusion occurrence information.

15 Claims, 7 Drawing Sheets

MAIN PROGRAM FLOW

INTRUSION DETECTION, REGISTER AND INDICATION APPARATUS

BACKGROUND OF THE INVENTION

Monitoring intrusions into a secured space is a great concern for a number of reasons. For example, a person who rents an apartment, office, or other like space may, as a condition of his or her lease provide permission to a lessor to enter the apartment or office space for certain specified reasons. Many such leases contain the requirement that the lessor must obtain the permission of the lessee as a courtesy prior to initiating routine entries. Nonetheless, lessees may wish to monitor such authorized intrusions into their secured spaces to determine if they have in fact occurred or even if multiple entries occurred when permission for a single intrusion was given. The prior art intrusion detection systems have focussed on monitoring unauthorized intrusions and have generally been associated with burglar alarm and other like systems that provide an audible or silent alarm upon the occurrence of an unauthorized intrusion. However, none of the prior art systems contemplate the need to monitor authorized as well as unauthorized intrusions such that entries such as those specified above may be monitored. Thus, there is a need for a low cost, simple, intrusion monitoring apparatus that can be utilized by individuals to monitor intrusions into secured spaces through portals or openings such as a door, window, gate or the like.

SUMMARY OF THE INVENTION

An apparatus for detecting intrusions into spaces of various kinds such as apartments, offices, lockers, and the like by either authorized or unauthorized persons is disclosed. The apparatus monitors a specific portal for intrusion occurrence events using an intrusion sensing unit, which communicates intrusion occurrence information to a remote, and possibly hidden monitor unit. The monitor counts the number of valid intrusion occurrence signals received from the sensing unit and stores the same in non-volatile memory. The number of intrusions stored in memory can be displayed on a display means at the monitor unit, which, in a simple embodiment would take the form of a single, seven segment light emitting diode (LED) display. In addition, the number of intrusions stored in the non-volatile memory can only be reset by the input of a unique, coded personal identification number (PIN) signal from an input keypad located on the monitor unit. More sophisticated embodiments incorporate date and time displays to indicate more specifically the events surrounding a particular intrusion occurrence. Even more sophisticated embodiments incorporate a printer for producing a hardcopy of intrusion occurrence information.

DETAILED DESCRIPTION OF THE PREFERRED EMBODIMENTS

Figure 1:
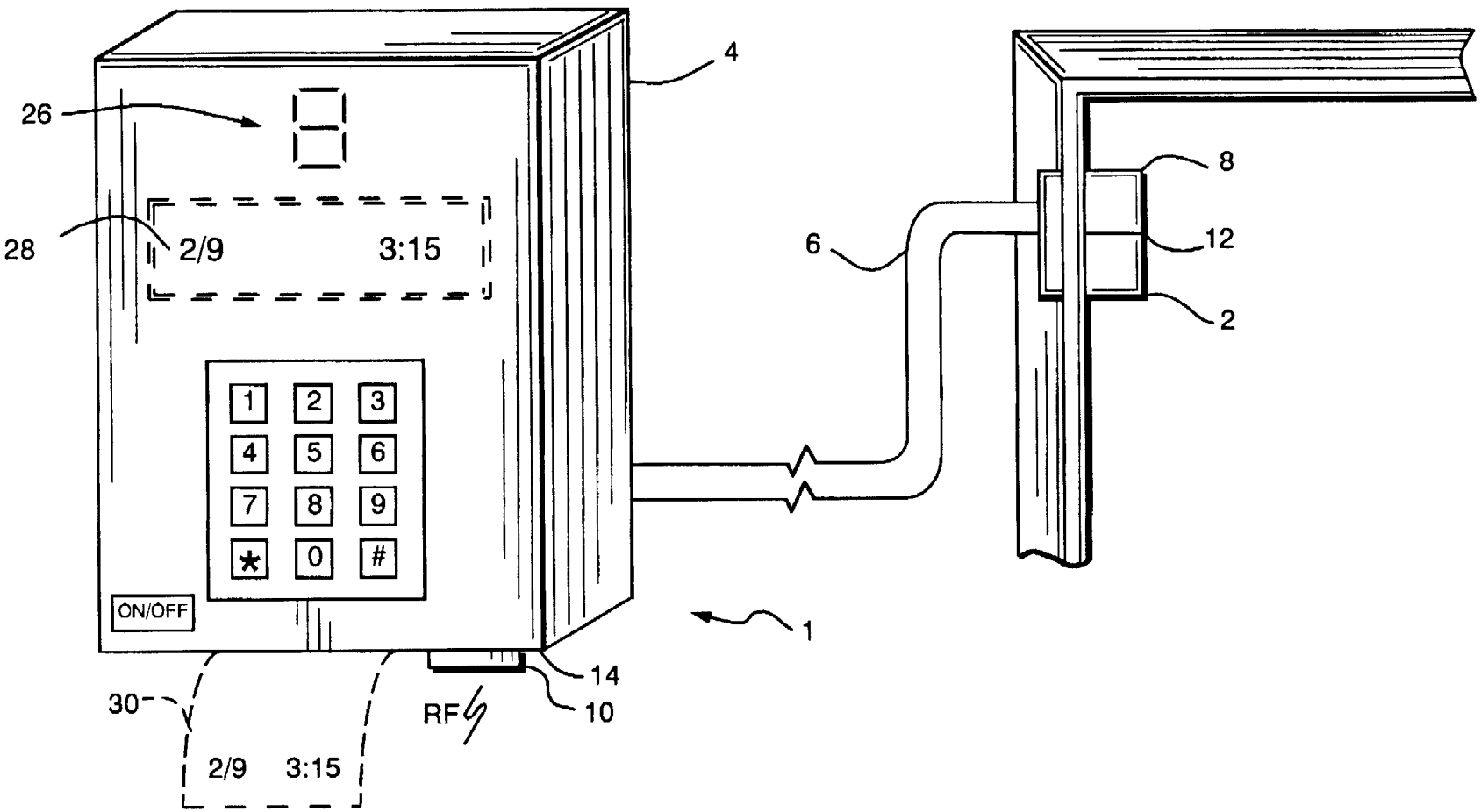
FIG. 1 shows the intrusion detection apparatus and its two main components, the intrusion sensor and the intrusion monitor.
Figure 2:
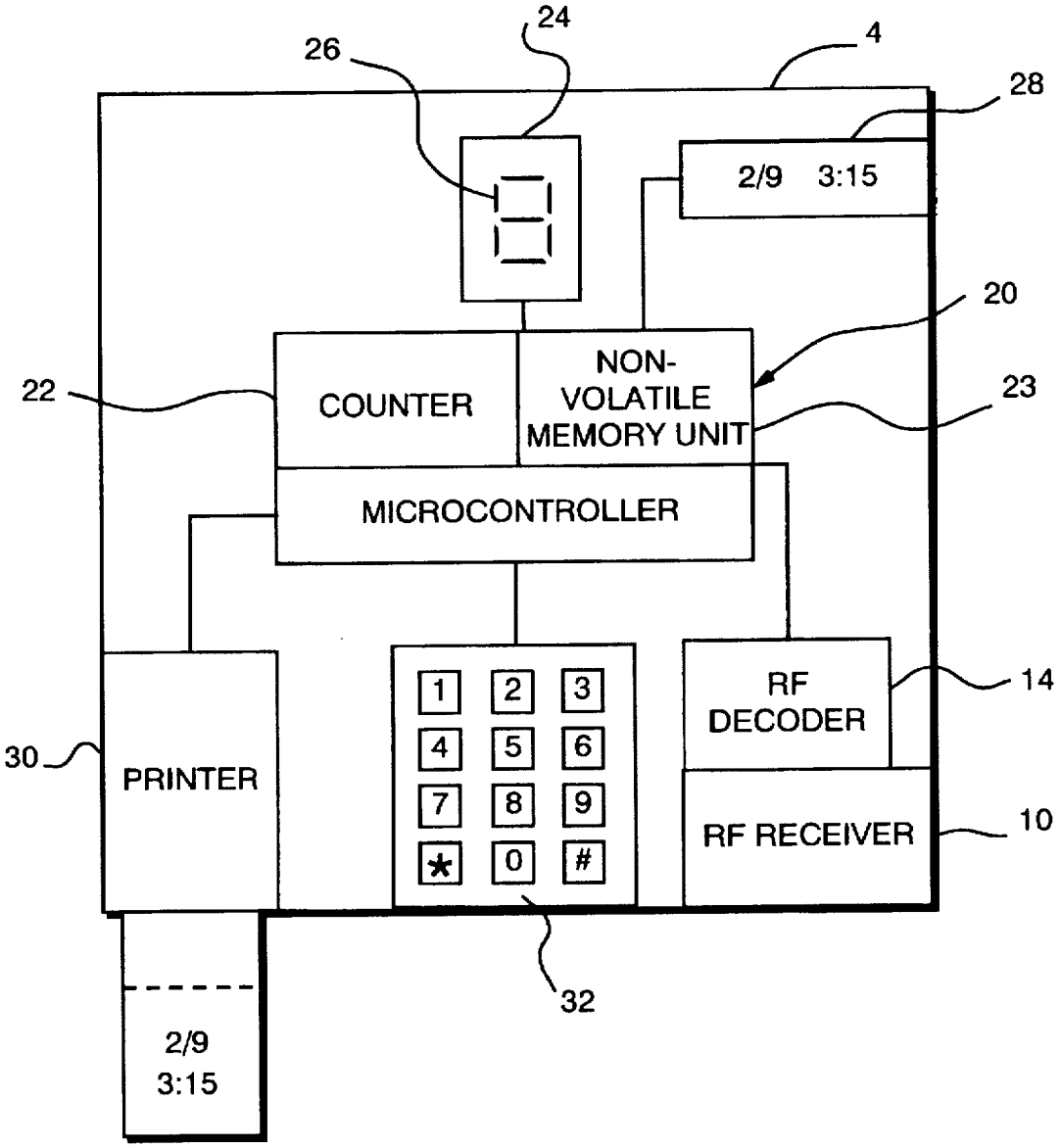
FIG. 2 is a block diagram showing the components of the intrusion monitor of FIG. 1.

Turning now to the Figures, FIGS. 1 and 2 show an apparatus for detecting intrusions into a secured space, through a portal or opening such as a door, window, gate or the like is shown and is generally designated as 1. The intrusion detection apparatus 1 can be used to monitor both authorized and unauthorized physical entries through any such portal of any enclosed space such as an apartment, office, locker, etc. Intrusion detection apparatus 1 comprises two main components, intrusion sensor 2 and intrusion monitor 4.

Intrusion sensor 2 can be selected from a variety of known types such as hall effect magnetic switches, magnetically activated reed switches or optical, sound, infrared, motion or other like sensors capable of detecting a discrete event, such as the opening of a monitored portal or the entrance or presence of an intruder in a secured space. Once an intrusion occurrence is detected by sensor 2, the intrusion occurrence is communicated to the intrusion monitor 4 through either a hard-wired electrical connection 6 or via common radio wave frequency (RF) signals using a transmitter 8, which is may be an integral component of intrusion sensor 2 or may be a separate unit, which receives an intrusion occurrence input from intrusion sensor 2 and transmits the occurrence to the intrusion monitor 4.

If RF signals are utilized, then intrusion monitor 4 will comprise a receiver unit 10, which will receive the RF signals from the intrusion sensor 2. Furthermore, to prevent spurious signals from being received by the receiver unit 10, the transmitter 8 and monitor 4 include RF encoder 12 and RF decoder 14, respectively. Both RF encoder 12 and RF decoder 14 are user adjustable using dipswitches (not shown). Thus a user of the intrusion detection apparatus can change the factory presets in the event that interference with the operation of the apparatus is detected from other RF transmissions, such as garage door opener signals, other intrusion detection systems or the like.

In any event, when transmitter 8 or hardwired sensor 2 detects an intrusion occurrence, a serial digital output signal will be communicated to the monitor unit 4. Monitor unit 4 is preferably comprised of a microprocessor device such as a micro-controller 20. When an intrusion occurrence signal is received by receiver 10, the receiver will send a digital signal to the microcontroller 20, which will cause counter 22, which is included within micro-controller 2, to index. Thus, counter 22 of monitor 4, will keep a count of the number of intrusions into a monitored area. The dynamic count will be stored in the monitor's nonvolatile memory unit 23 which is contained within the microcontroller 20, whether or not power is removed from the monitor unit 4. In addition to storing the count in the non-volatile memory unit, the monitor will display the dynamic count on display 24. Display 24 may be one or any number of display means capable of displaying the number of intrusion occurrences stored as the count in the non-volatile memory unit. In the most simple embodiment, display 24 comprises a single, seven segment light-emitting-diode (LED) 26, which would be capable of displaying the numerals "0" through "9". In a more sophisticated embodiment, the display 24 would include multiple LEDs or at least one liquid crystal display (LCD) (not shown). Furthermore, such sophisticated embodiments could include date and time display 28, which would display the date and time of each intrusion occurrence. Finally, a printer 30 could be included in the monitor unit 4, which would provide the capability of obtaining hard-copy records of the sequence of intrusions into the monitored space. Further outputs from the monitor 4 could be utilized to activate other "down stream" devices such as computers, cameras, telecommunications devices, alarms or the like.

The monitor is controlled by inputting various commands into keypad 32. The actual commands required to operate the preferred embodiment of the disclosed intrusion detection apparatus will be more specifically described hereinafter.

Figure 3:
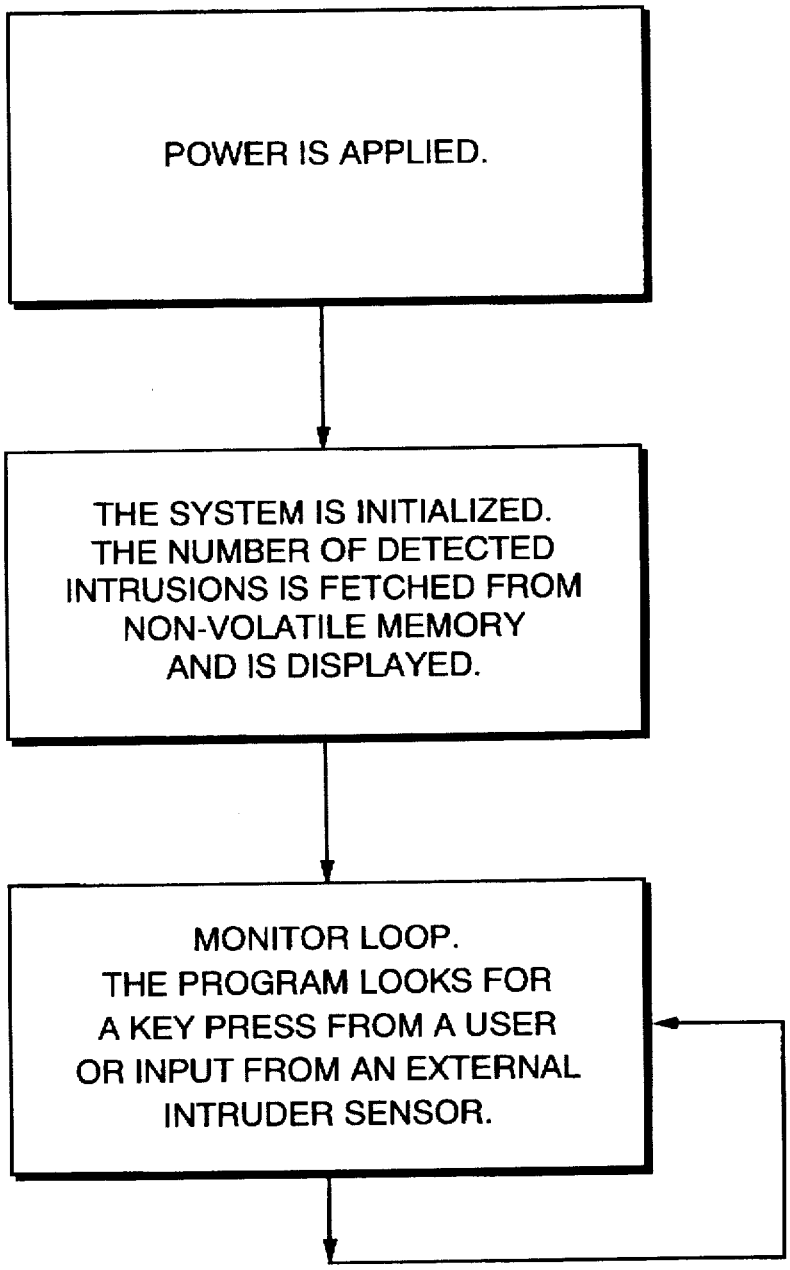
FIG. 3 is a flow diagram showing the main program flow.

Operation of the intrusion detection apparatus 1 can best be explained by referring to FIGS. 3–7 in conjunction with FIGS. 1 and 2. As shown in FIG. 3, when power is applied to the intrusion detection apparatus 1, the apparatus is initialized. The monitor 4 begins by retrieving the number of detected intrusions stored in the monitor's non-volatile memory unit and will display that number on the display device. When an intrusion occurrence signal is received by the monitor 4, the monitor's micro-controller 20 will detect each discrete impulse which has been segmented by a fixed time interval by a quartz crystal oscillator (not shown) in conjunction with at least one capacitor (not shown). The microcontroller 20 indexes the dynamic counter by one count for each discrete impulse detected as an intrusion occurrence and stores the total count of input pulses in the non-volatile memory unit 23. In addition to storing the count in the non-volatile memory unit 23, the micro-controller will display the count on display 24. In more sophisticated embodiments of the invention, the non-volatile memory unit will be configured to store the date and time of each intrusion occurrence as an intrusion occurrence record. Thus, in addition to an intrusion number, a user of the system will be capable of scrolling through the non-volatile memory unit and observe the day and time sequence of the various intrusions.

Figure 4:
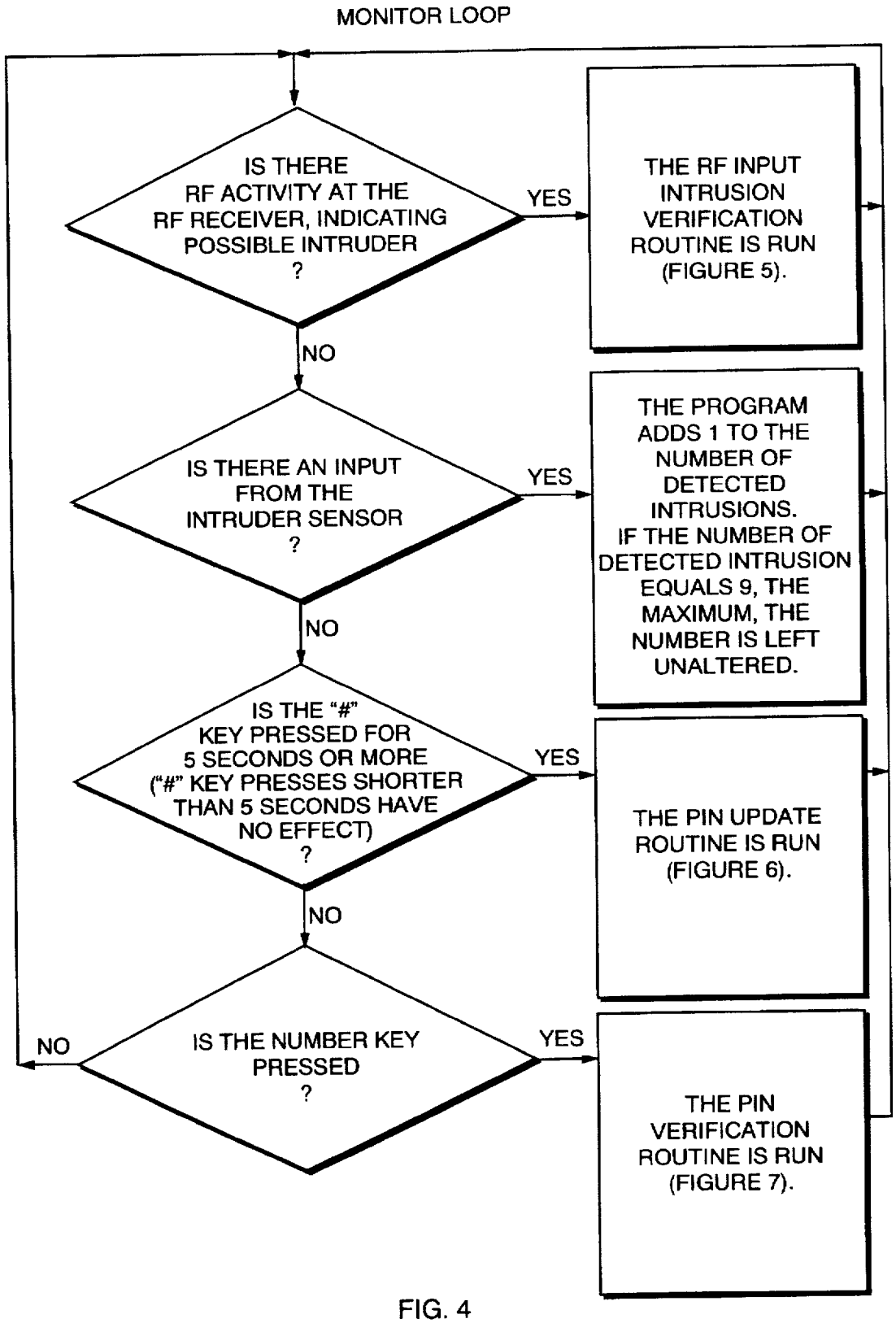
FIG. 4 is a flow diagram showing the monitor loop of FIG. 2.

Referring more specifically to FIG. 4, the monitor loop performs the central logic functions of the intrusion detection apparatus and controls the various subroutines performed by the apparatus. First, the monitor loop will monitor the activity of the intrusion sensor to determine whether there is any such activity, which would indicate the possibility that an intrusion into the monitored space has occurred. If a possible intrusion is detected, the monitor will initiate an RF intrusion verification routine. The monitor loop will also monitor the keypad to determine whether a user is inputting a recognized key sequence on the keypad. The monitor will recognize at least two keypad sequences, which will invoke a PIN update routine and a PIN verification routine respectively. Additional routines may be included as well due to the inherent flexibility of microprocessor-based micro-controllers.

Figure 5:
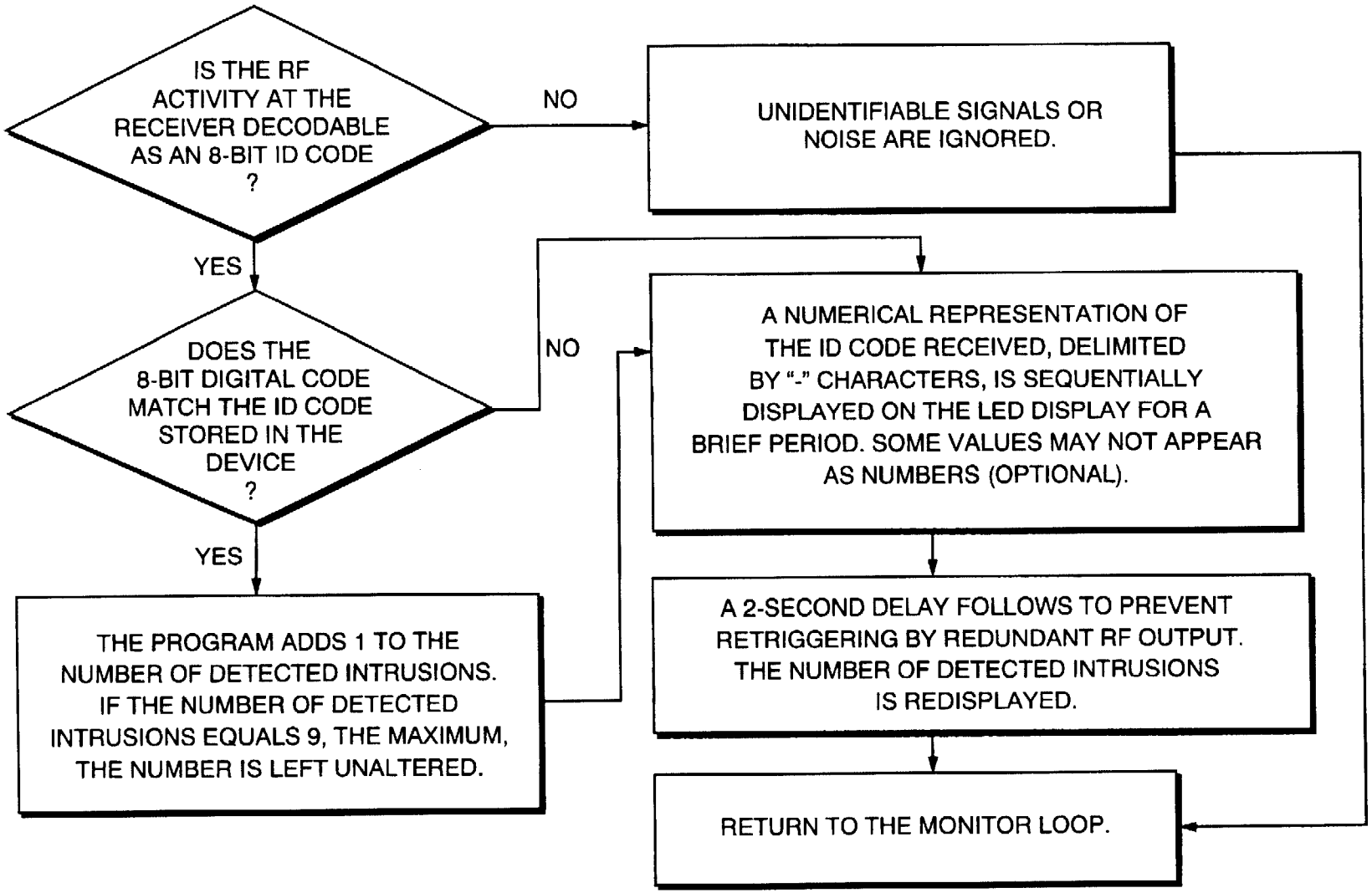
FIG. 5 is a flow diagram of the RF input intrusion verification routine.

Referring now to FIG. 5, the steps of the RF input intrusion verification routine are shown. First, the microcontroller will determine if the RF activity received by the receiver is decodable as an 8-bit ID code. If the received RF signal is not decodable as such, the microcontroller will classify the received signal as a spurious transient and will ignore the signal. On the other hand, if the micro-controller recognized the received RF activity as an 8-bit ID code, it will compare the received code from the ID code stored in the monitor unit's RF signal decoder. If the received ID code does not match the ID code stored in the RF decoder, then the received RF input will not be classified as an intrusion occurrence and will be ignored. In addition to ignoring the received RF signal, the micro-controller can be programmed to indicate the receipt of such a signal by, for example, displaying a numerical representation of the ID code received in sequence, delimited by "dashes" on the LED for a brief period.

If the received ID code matches the ID code stored in the RF decoder, then the microcontroller will add 1 to the number of detected intrusions stored in the monitor's non-volatile memory and replace the stored number of detected intrusions with the new number. In order to retrieve the count number stored in the unit's non-volatile memory, a user would depress a designated key on the keypad. To prevent unwanted retrievals resulting from erroneously pressed keys, the unit may be configured to require the user to hold the designated key for of a specified time period, for example, 5 seconds. Once the designated key is depressed, and held if required, then the micro-controller will display the number of detected intrusions stored in the non-volatile memory on the display. The number will remain on the display for a specified period of time, for example, 30 seconds, after which the display is deactivated. This would conserve the power necessary to light the LED display, which would result in enhanced longevity for battery powered intrusion detection systems.

In the case of a basic unit having only a single 7 segment LED as the display means, the micro controller will allow the number of intrusions detected to be indexed until the number of detected intrusions stored in the non-volatile memory equals nine (9). Once the number of detected intrusions equals 9, then the non-volatile memory will be left unaltered by the occurrence of additional intrusions. In this way, a knowledgeable intruder will not be able to merely cycle the portal used to enter the space a sufficient number of times to reset the display. Once the number of detected intrusions equals 9, the intrusion detection apparatus must be reset by user interaction.

After the micro-controller recognizes a valid intrusion occurrence, the micro-controller will institute a brief time delay before the RF receiver is capable of receiving additional signals. This will prevent the retriggering of the device by redundant RF inputs. In the preferred embodiment, a two second display has proved an acceptable period to prevent redundant counting of a single intrusion event.

Figure 6:
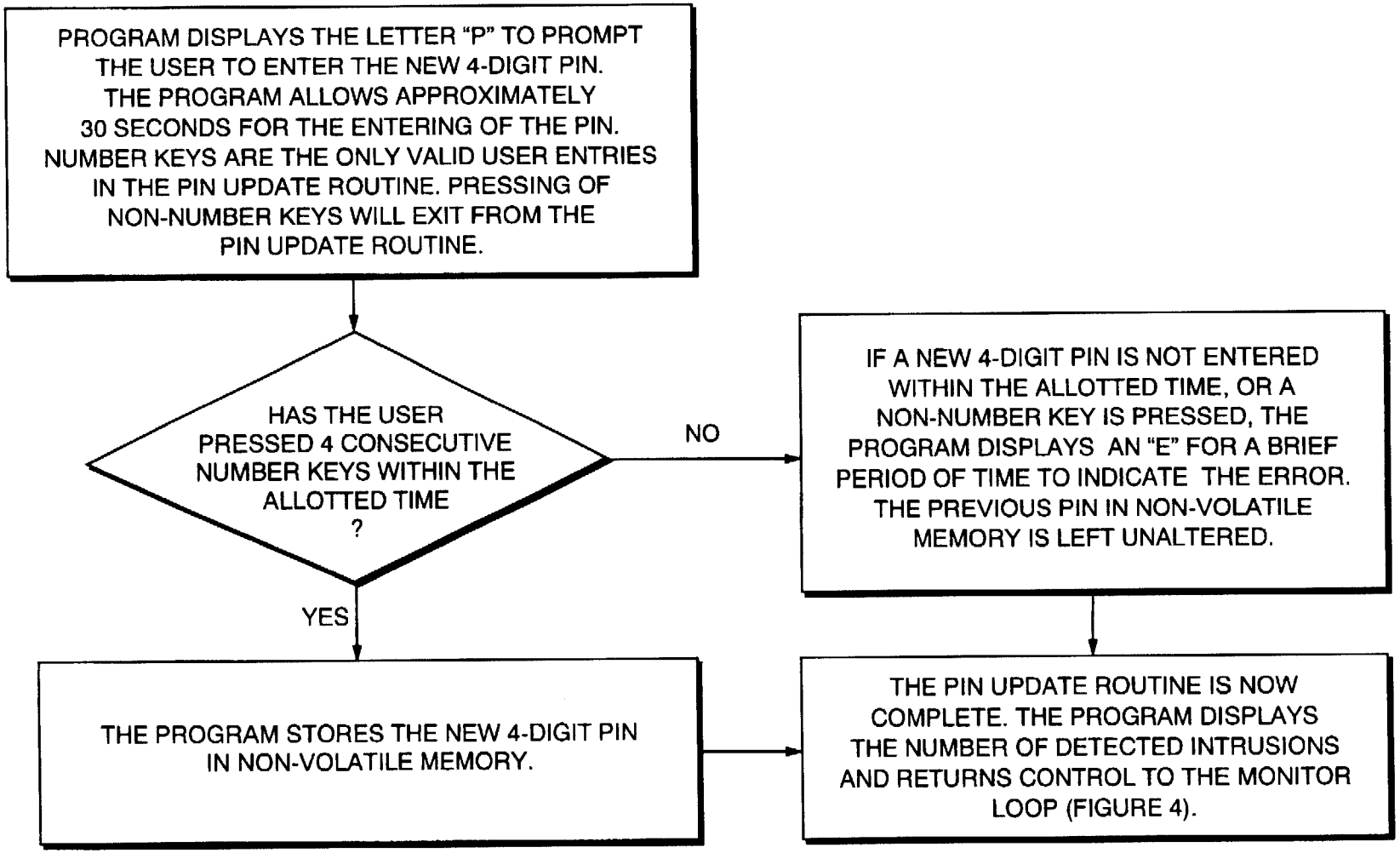
FIG. 6 is a flow diagram of the PIN update routine.

The PIN update routine is more specifically described with reference to FIG. 6. The PIN update routine may be invoked by operator interaction at any time during the monitor routine. In order to invoke this routine, the operator would enter the required key sequence to do so on the keypad. When the required sequence is entered, the LED will display the letter "P", which will indicate that the PIN update routine has been initiated. The program will allow approximately 30 seconds for the operator to input a unique PIN code, which will be used later in order to clear the non-volatile memory and display of intrusion occurrences that are recorded during any monitoring period. In the preferred embodiment, numbers are the only valid user entries for a PIN code. Inputting non-number keys on the keypad will result in the micro-controller automatically exiting from the PIN update routine. Once a user inputs his or her desired PIN code, which in the embodiment depicted in FIG. 5 comprises 4 consecutive number keys, the micro-controller will store the PIN code in the monitor's nonvolatile memory and will return to the monitor loop. If a proper PIN code is not entered within the allotted time, or a non-number key is pressed, then the micro-controller will cause an error message to be displayed on the display. For example, a static or flashing "E" may be displayed on the LED. Until a properly formatted PIN code is entered into the keypad during the PIN update routine, the previously stored PIN code will be left unaltered in the unit's non-volatile memory.

Figure 7:
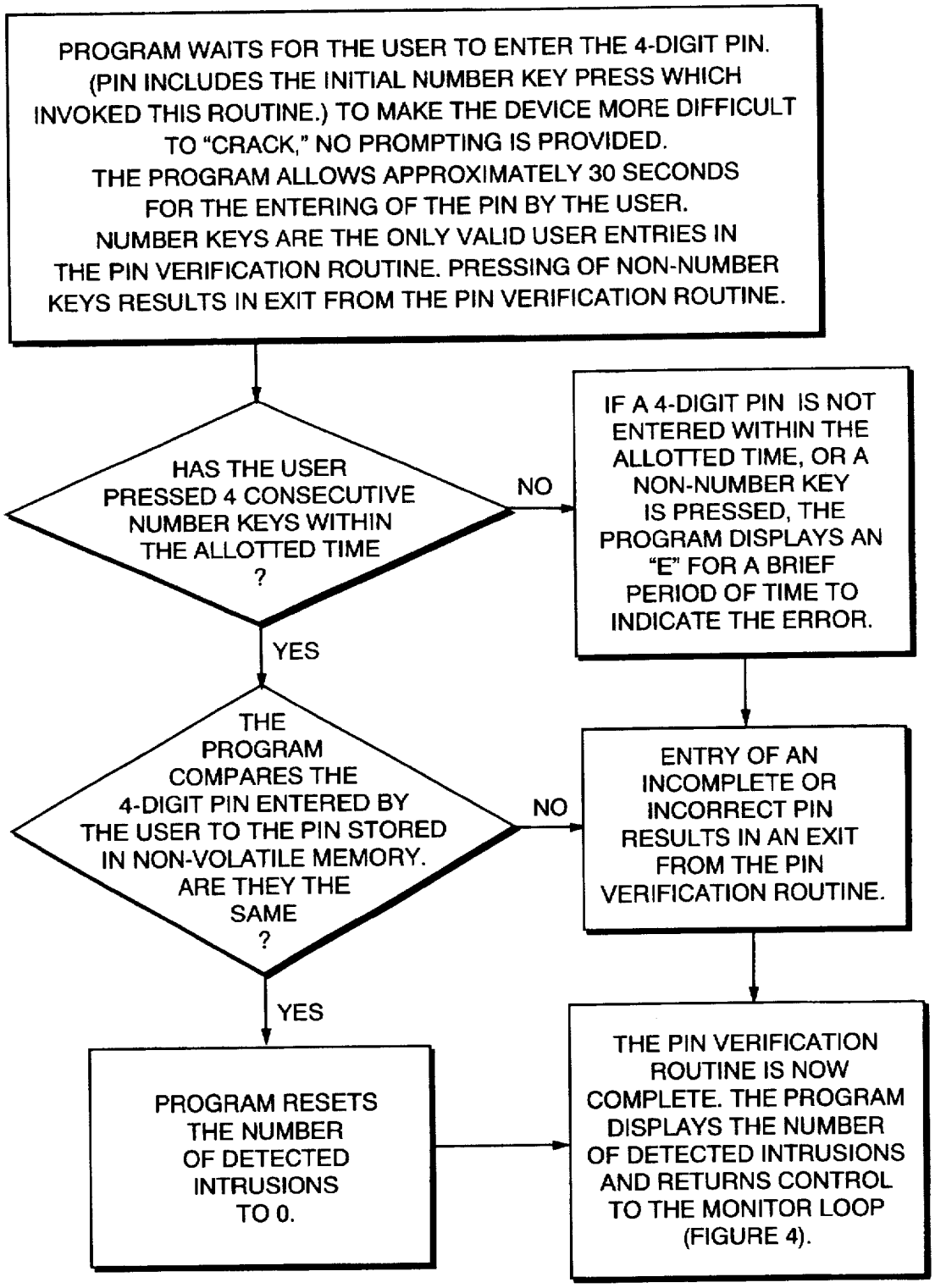
FIG. 7 is a flow diagram of the PIN verification routine.

Turning now to FIG. 7, the PIN verification routine is shown. The PIN verification routine is run by the micro-controller in order to allow a system user to reset the non-volatile memory and display after a period of access monitoring has occurred. Any time a user inputs a number key on the keypad, the micro-controller will monitor the sequence of keys entered and analyze the same to determine if it is an attempted PIN code input. As with the PIN update routine, the PIN verification routine requires that the key sequence be entered within a preset period of time, for example, approximately 30 seconds. If a properly formatted PIN sequence is not entered within the allotted time period, then the micro-controller will cause an error message to be displayed on the display. If a properly formatted PIN code sequence is entered, then the micro-controller will compare the properly formatted PIN code sequence entered with the authorized PIN code stored in the system. If a match is found, then the micro-controller will reset the number of detected intrusions stored in the unit's non-volatile memory to zero and will zero the display. The PIN verification routine is now complete and the micro-controller will return to the monitor loop. If a properly formatted, yet incorrect PIN code is entered, then the micro-controller will exit the PIN verification routine and return to the monitor loop as well.

Intrusion occurrences into more than one space can, with individual sensors for each, may be detected, identified and registered in the device with the appropriate duplicated circuitry and non-volatile memory capacity. Additionally, as options to the basic system, signal activation of alarm sounds, lights, cameras, computers, communication devices and the like can be accomplished in addition to the simple recording of intrusion occurrence information.

Various changes coming within the spirit of the invention may suggest themselves to those skilled in the art; hence the invention is not limited to the specific embodiment shown or described, but the same is intended to be merely exemplary. It should be understood that numerous other modifications and embodiments can be devised by those skilled in the art that will fall within the spirit and scope of the principles of the invention.

What is claimed is:

1. An apparatus for detecting intrusions into a secured space comprising at least one intrusion occurrence sensor and a remote intrusion occurrence monitor, said monitor comprising means for recording the number of intrusions into said secured space, a means for displaying said number of intrusions and a communications means for sending intrusion occurrence signals from said sensing unit to said monitoring unit, wherein said monitor further comprises a counter for maintaining a count of the number of intrusion occurrences into said secured space, wherein said counter indexes upon receipt of intrusion occurrence signals until a preset maximum number of occurrences are received at which time said counter is unalterable until reset by a user of the apparatus.

2. The apparatus for detecting intrusions into a secured space of claim 1, wherein said sensor comprises a hall effect magnetic switch.

3. The apparatus for detecting intrusions into a secured space of claim 1, wherein said sensor comprises a magnetically activated reed switch.

4. The apparatus for detecting intrusions into a secured space of claim 1, wherein said sensor comprises an optical detector.

5. The apparatus for detecting intrusions into a secured space of claim 1, wherein said sensor comprises an infrared motion detector.

6. The apparatus for detecting intrusions into a secured space of claim 1, wherein said sensor comprises a sound detector.

7. The apparatus for detecting intrusions into a secured space of claim 1, wherein said communications means comprises a hard-wired electrical connection between said sensor and said monitor.

8. The apparatus for detecting intrusions into a secured space of claim 1, wherein said communications means comprises a radio wave frequency signal transmitter co-located with said sensor and a radio wave frequency signal receiver co-located with said monitor.

9. The apparatus for detecting intrusions into a secured space of claim 1, wherein said display means comprises a date and time display to display the date and time of each intrusion occurrence.

10. The apparatus for detecting intrusions into a secured space of claim 1, further comprising a printer for printing a hard-copy of intrusion occurrence date and time data.

11. The apparatus for detecting intrusions into a secured space of claim 1, wherein said display means comprises at least one light emitting diode.

12. The apparatus for detecting intrusions into a secured space of claim 1, wherein said display means comprises at least one liquid crystal display.

13. The apparatus for detecting intrusions into a secured space of claim 1, wherein said display means comprises at least one seven section numeric light emitting diode.

14. The apparatus for detecting intrusions into a secured space of claim 1, wherein said monitor further comprises a means for resetting said count.

15. The apparatus for detecting intrusions into a secured space of claim 1, wherein said apparatus further comprises at least one down stream device, said down stream device being activated upon the monitor detecting an intrusion into said secured space.

* * * * *